US007124608B2

(12) United States Patent
Goop

(10) Patent No.: US 7,124,608 B2
(45) Date of Patent: Oct. 24, 2006

(54) PRESSING TOOL AND PRESSING PROCESS FOR EXTRUDING PRESS FITTINGS

(75) Inventor: Hans-Jörg Goop, Schellenberg (LI)

(73) Assignee: Emerson Electric Co., St. Louis, MO (US)

( * ) Notice: Subject to any disclaimer, the term of this patent is extended or adjusted under 35 U.S.C. 154(b) by 626 days.

(21) Appl. No.: 10/260,938

(22) Filed: Sep. 30, 2002

(65) Prior Publication Data

US 2003/0066324 A1 Apr. 10, 2003

Related U.S. Application Data

(63) Continuation of application No. 09/559,918, filed on Apr. 28, 2000, now Pat. No. 6,510,719.

(51) Int. Cl.
*B21D 39/00* (2006.01)
*H01R 43/042* (2006.01)

(52) U.S. Cl. ..... 72/21.3; 72/31.01; 72/453.16; 29/720

(58) Field of Classification Search ..... 72/1, 72/21.3, 31.01, 453.16, 453.15, 416; 29/720; 27/1, 21.3, 31.01, 453.16, 453.15, 416
See application file for complete search history.

(56) References Cited

U.S. PATENT DOCUMENTS

| | | | | |
|---|---|---|---|---|
| 5,195,042 | A * | 3/1993 | Ferraro et al. | 29/753 |
| 5,231,352 | A * | 7/1993 | Huber | 324/207.24 |
| 5,335,531 | A | 8/1994 | Mann et al. | 72/416 |
| 5,490,406 | A | 2/1996 | College | 29/720 |
| 5,611,228 | A * | 3/1997 | Dummermuth | 72/21.2 |
| 6,035,775 | A * | 3/2000 | Nghiem | 100/43 |
| 6,244,085 | B1 * | 6/2001 | Dummermuth | 72/31.1 |
| 6,510,723 | B1 * | 1/2003 | Amherd | 72/453.16 |

FOREIGN PATENT DOCUMENTS

| | | |
|---|---|---|
| DE | 199 46 380 | 4/2000 |
| EP | 0 712 696 | 5/1996 |
| EP | 0 941 813 | 9/1999 |

OTHER PUBLICATIONS

U.S. Appl. No. 10/238,859, filed Sep. 11, 2002, Hans-Joeg Goop.

* cited by examiner

*Primary Examiner*—Daniel C. Crane
(74) *Attorney, Agent, or Firm*—Locke Liddell & Sapp LLP

(57) ABSTRACT

A pressing tool (13) includes a fluid pump (4), a cylinder element (5) arranged connecting with this and a piston which can be slid forward in the cylinder element (5) by pressure fluid of the fluid pump (4) and reset by a return spring (20*a*). A piston rod (6) is passed out to the cylinder element (5) as an activation part. The pressing tool (13) is moreover outfitted with a position measuring device (12, 12*a*; 112, 212, 212*a*) which measures without contact which makes the piston position continuously detectable over a positioning range free of disturbance and with a presence sensor (52). The presence sensor (52) verifies the presence of a jointing clamp (51) and issues an indicator signal in the event that a jointing clamp (51) is missing or improperly fastened and shuts the pressing tool (13) off following a delay period to the extent that no orderly inserted jointing clamp (51) is yet available. The pressing tool (13) can also characterize the quality of the extrusion on the basis of the comparison of a detected maximal piston end position with a specified piston position range value.

9 Claims, 4 Drawing Sheets

PRESSING TOOL AND PRESSING PROCESS FOR EXTRUDING PRESS FITTINGS

Figure 1:
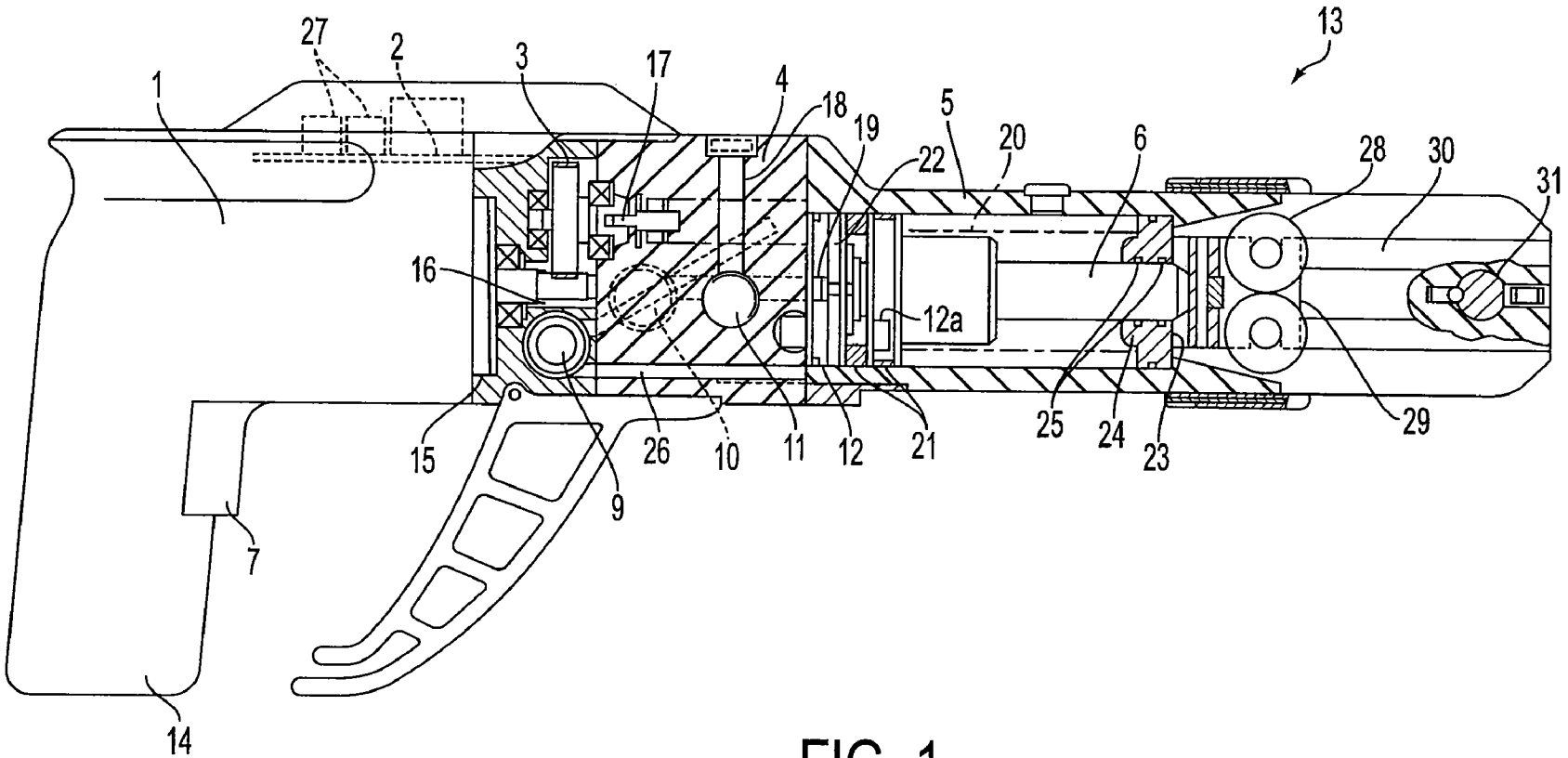

This is a continuation of co-pending application Ser. No. 09/559,918, filed Apr. 28, 2000, now Pat. No. 6,510,719.

The invention relates to a pressing tool for jointing clamps of various sizes according to the preamble of claim 1 and a process according to the preamble to claim 9.

Pressing tools for pressing casing-like press fittings home on pipe ends must guarantee that the jointing clamps always press the press fitting home properly. For the common press fitting diameters, appropriate jointing clamps are insertable in any given case into the pressing tool. Because great forces are required for pressing home, a hydraulic cylinder is used for actuating the jointing clamps in various known pressing tools. Embodiments are known from U.S. Pat. No. 5,125,324 where an electric motor drives a hydraulic cylinder. The fluid acted upon by pressure is guided into a hollow cylinder to activate a piston which activates the pressing tool or the jointing clamp. A compact activation unit arises through the pump with electric motor arranged directly on the lifting cylinder. At the end of the pressing process, excessive pressure arises in the cylinder, which leads to opening the excess pressure valve and therewith to ending the pressing process. The piston is reset by a return spring while recirculating the liquid into a collection area. Monitoring complete pressing home takes place through the threshold pressure which is necessary for opening the excess pressure valve. Different forces of pressure are needed for optimal pressing home of various press fittings in any given case. With a pressing tool which generates a force which goes beyond the necessary pressing force due to a fixed threshold pressure for all pressing processes between the open dies, a large proportion of the force is absorbed by the open dies. These must correspondingly be constructed with excessive dimensions and are subject to increased abrasion. If the open dies jam, then the threshold pressure, and consequently the end of the pressing process, can be reached without the press fitting being pressed home correctly.

From DE 297 14 753 U1,a pressing tool with two interacting open dies is known where a spacing receiver is constructed between the open dies. Here a relocatably mounted plastic stop pin pressed from the outside by a spring from the first open die projects against a stop face of the second open die. If the open dies are moved toward one another, the pin is pressed into the first open die by the stop face. A metal casing fixed upon the pin is moved over the area of two sensors when the bolt is moved. The oscillating circuits of the sensors are detuned on the basis of an eddy current induction when a metal casing is placed significantly close. Three different fastening bolt position ranges can be recorded. In a first position range, the casing is only in the vicinity of the first sensor. In a second position range, casing segments are in the vicinity of both sensors. In a third position range, the casing is only in the proximity of the second sensor. The casing and the sensors are now dimensioned or set at a distance such that the first position range is allocated to bringing the open dies together before the pressing process. The second position range is allocated to the pressing process and reaching the third position range corresponds to the end of the pressing process.

This spacing receiver can consequently be used for ending the pressing process. Here, entering into a specified position range is recorded for ending the pressing process between the open dies. All usable jointing clamps must consequently have a spacing receiver. After inserting a jointing clamp, the spacing receiver must be connected with the control unit of the pressing tool. The advantage of a jointing clamp position recording is associated with the disadvantage of the expensive construction of the jointing clamp and the expense of a separate electrical connection of the jointing clamp to the pressing tool.

A crimping tool for pressing home electrical cables with connections is known from U.S. Pat. No. 5,113,679 which supplies the activation pressure when two grips are pressed together with a pump cylinder. During extrusion, a tamping tool connected to the press plunger is moved against a crimp anvil by the press plunger In order to be able to measure the position of the stamping tool, an electrical resistor strip is provided on the crimping tool and contact elements which can be slid over it are provided on the press cylinder. Owing to contamination or oxidation of the resistor strips, false positional values can be recorded. With false positional values, even the quality of the pressure can be falsely indicated, which impairs an efficient operation with the crimping tool. Moreover, no casings can be pressed home.

Underlying the invention is the objective of finding a safely operating pressing tool. In addition, a pressing process with such a pressing tool should guarantee that the pressing can be safely implemented with all insertable jointing clamps.

This objective is accomplished with the features of claims 1 to 9. The dependent claims describe alternatives or advantageous construction variants.

In accomplishing the objective, it was recognized that with a contact-free or contactless measuring position measuring device which makes the piston position continuously recordable over a positioning range. The current piston position can be determined with certainty at least at one point in time. It thus does not need to be fixed in advance at which position a jointing clamp present check should be conducted by the positioning of a presence sensor. Any desired piston position can be recorded within the positioning range. Because the position recording takes place contact-free or without contacts, no disturbances can occur owing to contaminated sliding contacts. The at least one point in time in which the position should be measured depends upon the activation process. In extruding a press fitting, the piston position is preferably recorded when the threshold pressure is reached, directly before a return valve is opened, or forwarded to a control unit or comparison unit. This piston position is a measure for the quality of the extrusion because the maximal feed obtained is associated with most narrow open die position derivable from the open die shape or mounting or by the open die parameters. If the threshold pressure is reached before complete extrusion, then in this way a piston position is detected which does not correspond to a specified piston position range value, or which does not lie in a tolerance range around the piston position range value. On the basis of the comparison of the piston position recorded with at least one lower range threshold, the quality of the extrusion can be characterized.

With the preferred embodiment of the pressing tool, the result of the comparison is used to initiate a two-valued indication. With a complete extrusion, for example, a green signal is turned on and/or with an incomplete extrusion, for example, a red signal is turned on. It is obvious that, instead of an indication, a signal tone can also be provided. If attaining an effective open die position is being examined, errors which arise in connection with a pressure monitoring can be ruled out. The jointing clamps require no spacing receiver. Any number of standard jointing clamps can be used. The pressing process can be conducted independently of position monitoring whereby, however, position recording serves to monitor the quality of extrusion.

If need be, however, the position measuring device is connected with the control unit of the pressing tool. Then the drive of the fluid pump and/or at least one valve of the fluid conduit system can be controlled independently of a recorded piston position. Preferably, the pressing process is ended upon reaching a piston position necessary for complete extrusion. In this way, building up a standard threshold pressure can be dispensed with. In addition to process control on the basis of continuous monitoring to the piston position, and in particular current open die parameters, a magnitude derived from piston positions, such as piston speed or piston acceleration, can be used to influence the course of the process.

The pressing tools in accordance with the state of the art can be used with many different interchangeable jointing clamps. The various jointing clamps are constructed for pressing copper and steel fittings with diameters of 12, 15, 18, 22, 28, 35,and 54 mm, or for joining plastic pipes with diameters of 16, 20, 25, 32 mm. In addition to these standard magnitudes, special jointing clamps are also known for connections with diameters of 76.1, 88.9 and 108 mm. It is evident that the insertable jointing clamps can have any desired pressing diameter. In accordance with the respective guide of the open die motion and the connection to the piston rod, a coordination between the desired position of the open die in connection with complete extrusion and the piston position necessary for this for all jointing clamps is to be determined.

If the piston position required for the various jointing clamp sizes is different, then preferably a recording unit is provided which makes a jointing clamp coordination, preferably a piston end position or a range for it, inputtable or recordable. In this way, it should be guaranteed that the comparison of the recorded piston position always takes place with the correct position range value for the jointing clamps used. For this, the measuring unit is connected with the control or comparison unit.

If the operators must input the identification for the current jointing clamp on the recording unit, then a monitoring device can be provided which requires inputting the identification of the new jointing clamp when changing a jointing clamp or when inserting the fastening bolt. The recording unit is, however, preferably equipped with a sensor device and can therewith automatically identify or record the jointing clamp inserted, especially the piston end position allocated to it. The identification should take place free of contacts or without contacts because otherwise disturbances can occur due to contamination, oxidation or short circuit. A preferred solution provides that the sensor device includes at least one Hall sensor allocated to the pressing tool which identifies the jointing clamp or the corresponding piston end position on the basis of the magnetic field originating jointing clamp. Disturbances of jointing clamp coordination as a function of contamination or moisture can be ruled out by measuring of a magnetic field characteristic. In order to make 32 different jointing clamp coordinations possible with little expenditure, the possibility of installing a permanent magnet or coordination magnet is provided at about five positions on the jointing clamp. For this, blind bore holes are created. The positions for coordination magnets lie opposite appropriately arranged coordination Hall sensors when the jointing clamp is inserted so that the coordination Hall sensors make the presence of coordination magnets possible. A greater number of coordinations is made possible through a larger number of Hall sensors and positions for magnets.

If a jointing clamp characterization is used as a coordination, then the pressing tool must assign a piston position range value to each jointing clamp characterization in order to be able to compare the current piston position with this range value characterizing a complete extrusion at the end of the pressing process. With such a two-stage coordination, the problem emerges, however, that the tables of the pressing tool are supposed to be supplemented in connection with the appearance of new jointing clamp types. It has become apparent that the most efficient coordination possible does not emerge from recognizing the type of the jointing clamp, but rather directly from the recognition or coordination of the piston or the piston position range value. If thus the coordination classes described as above by means of five magnet positions $2^5$, or 32, then 32 different piston position range values can be defined in the pressing tools. The jointing clamps to be recognized must then in any given case be attributed to one of these 32 classes. This assignment is possible for new types of jointing clamps and even for jointing clamps from other manufacturers as long as the piston end position required lies in a predefined range. Then it only needs to be guaranteed for the proper range value allocation that the jointing clamp is provided with magnets at the right places. It would also be possible, if need be, for the user of such pressing tools to be able to-construct a coordination himself by applying blind bore holes and pressing in the magnets.

With a coordination of the piston position range value of this type, it is possible for jointing clamps of wholly different sizes to be characterized identically because the piston end position for these jointing clamps lies in the same range. Because the overall range in which the piston position range values of current jointing clamps only extends over ca. 20 mm, a coordination with 32 part ranges suffices. With a less fine distribution, fewer than five positions for magnets would suffice. With a larger overall range and/or more narrow part ranges, more than five positions could also be provided for coordination magnets. At the end of each pressing process, the current piston end position is compared with the piston end range value allocated to the jointing clamp. If the current position end value of the piston lies under the piston position range value or beneath the allocated tolerance range, then the jointing clamp was not completely closed, which is indicated preferably by a warning signal. If the current position end value lies above the piston position value range or above the allocated tolerance range, the jointing clamp is deformed or broken which once again is preferably indicated by means of a warning signal. This can also, if need be, lead to switching the pressing tool off.

The lifting cylinder device of the pressing tool is an activation module which makes great forces available in the piston feed direction, and makes any desired piston positions exactly measurable over the entire positioning range on the basis of the position measuring device. Because the cylinder element is arranged connecting directly to the fluid pump with drive, a compact construction results. The fluid conduits and at least one valve are arranged in the joining area of the pump and the cylinder element. The drive is preferably connected through a power transmission with the pump and can be adapted to the use in question. The drive motor of the pump is preferably an electric pump whose actuation is connected with the control unit of the lifting cylinder device. This control unit makes the triggering of a desired activation sequence through an actuation connection. A resetting element, especially a return spring, is arranged preferably in the cylinder element for resetting the piston. The piston rod is guided from the cylinder element as an activation part.

In order to use the cylinder space as optimally as possible with a hydraulically activated piston, a fluid receiving area is constructed on the side of the cylinder facing away from the activation pressure, thus in the region with the return spring. For this, the cylinder element is tightly closed off on both front faces. The piston rod is correspondingly passed through a seal.

The position measuring device which measures free of contacts or without contacts makes possible, preferably, a distance measurement between the cylinder element and the piston, whereby preferably a Hall sensor and a magnet or a position Hall sensor and a position magnet, if necessary a laser interference or laser diffusion distance sensor and a reflection surface are arranged or constructed on each one of the two elements. When using a Hall sensor, this is preferably fastened on the cylinder element in the region of the front face, especially on the front face with pressure fluid feed. The magnet or position magnet is arranged on the piston. The magnetic field strength in connection with the Hall sensor or position Hall sensor, which measures this, depends upon the piston position or on the position of the magnets. A piston position can now be allocated to each value of the Hall sensor by means of a calibrating curve. Care must be taken in connection with the placement of the Hall sensor and the magnets that an unambiguous coordination between the measured value of the Hall sensor and the piston position is guaranteed in the entire desired position range. The distance measurement with the Hall sensor can be conducted sufficiently accurately with economical and small components.

With laser interference measurement and laser diffusion measurement, the laser light reaches from one front face of the cylinder element over a reflection on the piston back to the front face again. The piston position is determined from the phase shift between the outgoing beam and the beam reflected on the piston with interference measurement. With laser diffusion measurement, the intensity of the light reflected on the piston is used as a measure for the piston position. In addition to distance measurements with light, analogous measurement devices with high frequency ultrasound are possible, whereby then, however, problems can arise due to pressure oscillations in the pressure fluid because the speed of sound propagation depends upon pressure. Moreover, the laser and ultrasound systems are still relatively expensive at this time, so that measurement with a Hall sensor is preferable.

In addition to effective distance measurement, the position measurement device with position readings, especially with an increment scanner, is very widespread and correspondingly beneficial. For this, a reading head must be movable along a scale. When measuring the piston position in the cylinder element, the reading head is fastened preferably on the cylinder element owing to the connecting cable. Correspondingly, the scale is fastened on the piston or on the piston rod, or is set in motion by this by a transmission of motion. Since the piston rod is guided through a seal in a preferred, compact construction of the lifting cylinder device, the scale must also be passed through this seal. The reading head is then arranged on one of the two sides of the seal. The scanning takes place optically or inductively. Since inductive scanning is possible without problems on a band with locally different magnetization, an inductive scanning is consequently preferred. Such magnetized measurement bands are robust and can perhaps be pressed into fitting depressions in the piston rod so that the piston rod can be sealed off A further aspect is that, in order to increase safety for operators as well as for the pressing tool, and to increase the quality of extrusion, a jointing clamp presence check is helpful. The pressing process is not conducted flawlessly when the jointing clamp is improperly inserted, and the forces arising can damage the pressing tool. Operating personnel can also be injured in this context. This jointing clamp presence monitor can be installed in pressing tools independently of the piston position measuring device.

The jointing clamp presence check prevents initiating a pressing process as long as no jointing clamp is inserted into the fork-shaped connection element. If no jointing clamp inserted in an orderly manner is available after a specified delay period and repeated jointing clamp monitoring, the pressing tool is returned to the initial state. Once the pressing process has been initiated, then the jointing clamp presence check leads to an interruption of the pressing process if the joint tool no longer sits correctly in its anchoring. With this jointing clamp presence monitoring, the same applies as with jointing clamp coordination. It should be a check which functions even with strong contamination and in a moist environment. Therefore a sensor which measures without contact, which makes a field property determinable, which is clearly distinguishable when the jointing clamp is present and absent [is required]. For this, for example, a presence magnet can be provided on the jointing clamp which is recordable by a presence Hall sensor of the pressing tool. Because even old jointing clamps or jointing clamps by other manufactures should be installable, it is, however, advantageous to install an inductive sensor for jointing clamp presence monitoring which makes the presence of any desired jointing clamp detectable. But other sensors or mechanical switches can also be installed which respond upon contact.

If the jointing clamp is present, it must in addition be assured that the fastening bolt which connects the jointing clamp with the pressing tool is properly installed. Since it was established that a pure bolt latching check guarantees no sufficient security against a partial insertion, or in the worst case with the fastening bolt sliding out, a bolt latching check is described with which a completely installed fastening bolt can be moved or rotated into a latching position which is monitorable. A sensor which measures without contact should be used which makes a field characteristic determinable which is clearly distinguishable in connection with the presence or absence of securing the fastening bolt. For this, a latching element of the fastening blot nay be provided with a latching magnet which in the latched state or in the latching position bounds upon a latching sensor in the pressing tool. If the latching sensor detects a magnet, then the fastening bolt is in the latching position. It is obvious that instead of the Hall sensor, for example an inductive sensor can also be used. Since the fastening bolt belongs to the pressing tool, one may proceed from the assumption that the pressing tool is always outfitted with a fastening bolt with latching magnets.

In order to be able to check with little expenditure whether the jointing clamp is properly or securely installed, the presence sensor and the latching sensor are arranged in a series or circuit. The pressing tool is preferably only activatable if the jointing clamp is installed and the fastening bolt is latched. If need be, however, the presence of the jointing clamp is provided for the activatability of the pressing tool, and fastening bolt which is not latched leads to an acoustic and/or optical warning signal. If, despite the warning signal, a pressing process is triggered, then the unbraked piston motion can lead to damage to the pressing tool. In order to retain the reason for such damage for guarantee or product liability questions, it is appropriate to store the activation without secured fastening bolt in a fault storage.

Since the possibility of insertion of a jointing clamp without fastening bolts is more difficult than installing a fastening bolt without jointing clamp, the jointing clamp presence check is more secure with relation to the jointing clamp as a condition for the ability to implement a pressing process than checking whether a fastening bolt is inserted or latched.

A pressing tool with a latching sensor which measures without contact, preferably with a Hall sensor, is also new and inventive independently of a position measuring device. The detection of the latching or a securing measure has the advantage in relation to the state of the art in accordance with European patent application No. 95810595.9-2306 that an undesired motion or falling out of the fastening bolt can be ruled out. Further advantageous embodiments arise in combination with a presence sensor which have already been described above on the basis of the pressing tool with the position measuring device. Here it should be considered that, in addition to the presence of the latching sensor and if need be the presence sensor, their use—as will be discussed by way of example below—is also new and inventive in the pressing process, especially independently of the use of the piston position detection and/or jointing clamp coordination.

With the sensors described above for the jointing clamp presence check, the bolt latching monitoring and the coordination detection, a pressing process can be conducted in connection with which the extrusion is securely implementable with all installable jointing clamps. The pressing process includes initializing steps or tests after turning on the pressing tool. Before a pressing process is rendered capable of being triggered, a jointing clamp presence check takes place which detects whether a jointing clamp is installed or not. If no jointing clamp is present, an acoustic and/or optical indication signal is triggered and subsequently the jointing clamp presence check is conducted again. If still no jointing clamp is installed, or is defectively installed following a delay period, the pressing tool is returned to the initial state by a delay period facility. The pressing tool cannot be started. In order to initiate a pressing process again, a jointing clamp must be introduced into the pressing tool and fastened to the pressing tool by means of the fastening bolt. In the event that a jointing clamp was already present, care must be taken that the jointing clamp in correctly inserted into the connection element. If it is detected in the jointing clamp presence check that a jointing clamp is installed, then a coordination detection is conducted after a short delay time. Here a standard range or standard values are allocated in connection with defective coordination. As a further check prior to approval of the triggerability of a pressing process, a bolt latching check is conducted. For conducting the latching check, the pressing tool includes at least one sensor, especially one which measures without contact. If the fastening bolt is not latched, or in the securing position, this is detected by the latching sensor and indicated at least with an acoustic and/or optical warning signal. If need be, the bolt latching check is repeated until the fastening bolt is latched or secured. Following successful implementation of these surveillance steps, the pressing tool is ready for triggering a pressing process.

The pressing process is associated with further monitoring checks. For this, reaching a pressure value—in particular, the time elapsed until a pressure value is reached—is monitored in the lifting cylinder device. When this pressure value is reached, the current piston position is detected and a resetting procedure is conducted to reset the piston. A time control determines whether the time required to attain the pressure value lies above a specified threshold time. If this is the case, then an acoustic and/or optical warning signal is triggered and preferably an appropriate error code is stored. If the piston end position detected does not correspond to the piston position range value corresponding to the coordination detected or does not lie within the appropriate tolerance range, then an acoustic and/or optical warning signal is triggered and preferably an appropriate error code is stored.

Before a further pressing process is made triggerable, the sequence described above with a jointing clamp presence check, a coordination check and a bolt latching monitoring takes place again. In order to prevent the possibility of a jointing clamp being removed after these control operations and a pressing process being subsequently triggered, the monitoring steps are repeated at specified intervals of time or, if need be, in connection with the triggering activation for a pressing process. If during a specified maximal resting time no pressing process is triggered, then the pressing tool is shut off.

Figure 2:
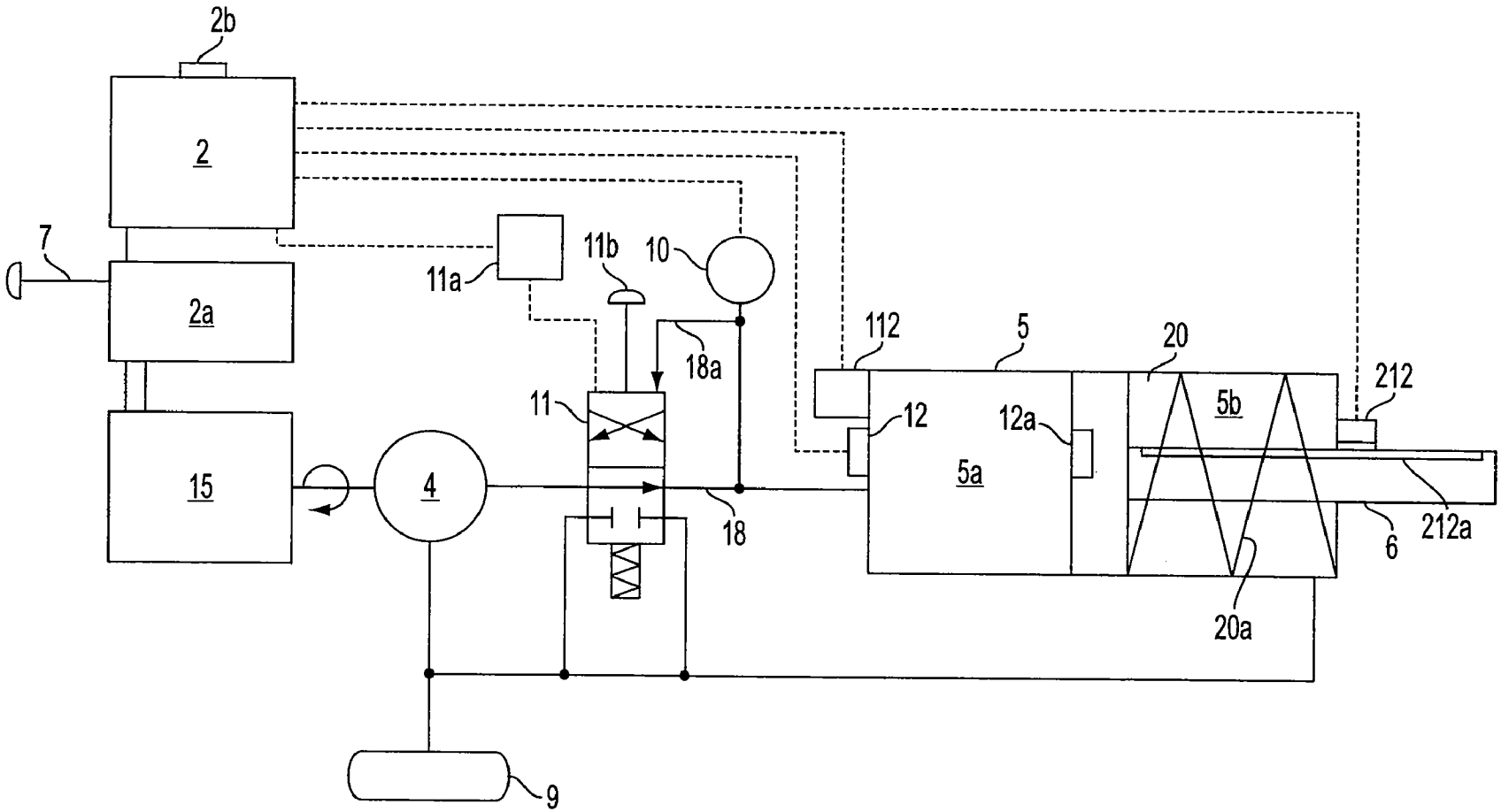
Figure 3A:
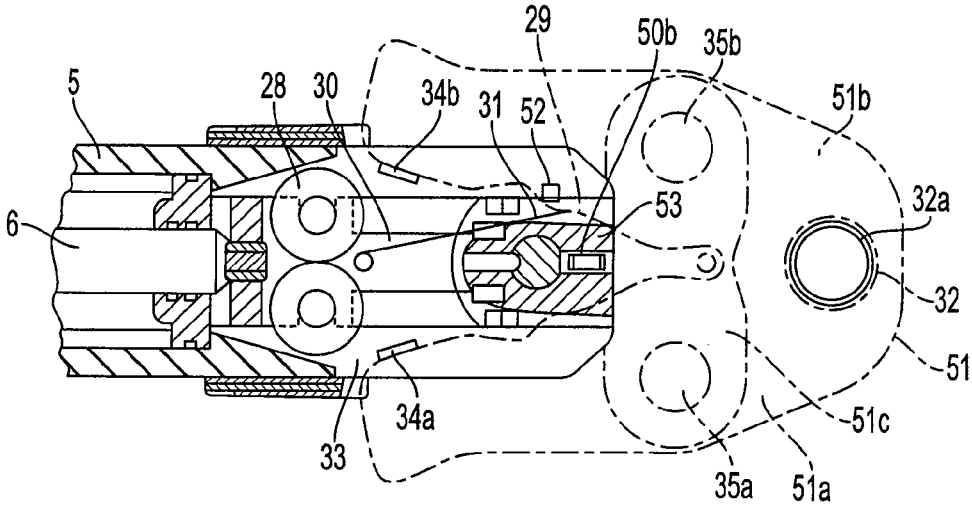
Figure 3B:
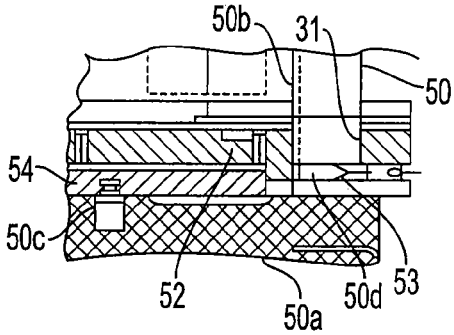
Figure 4A:
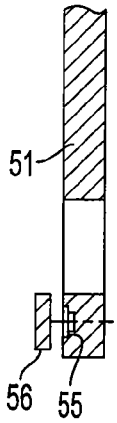
Figure 4B:
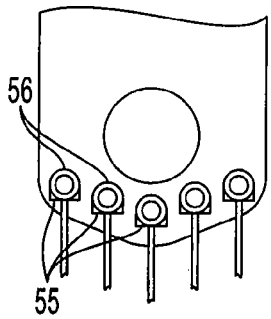
Figure 5:
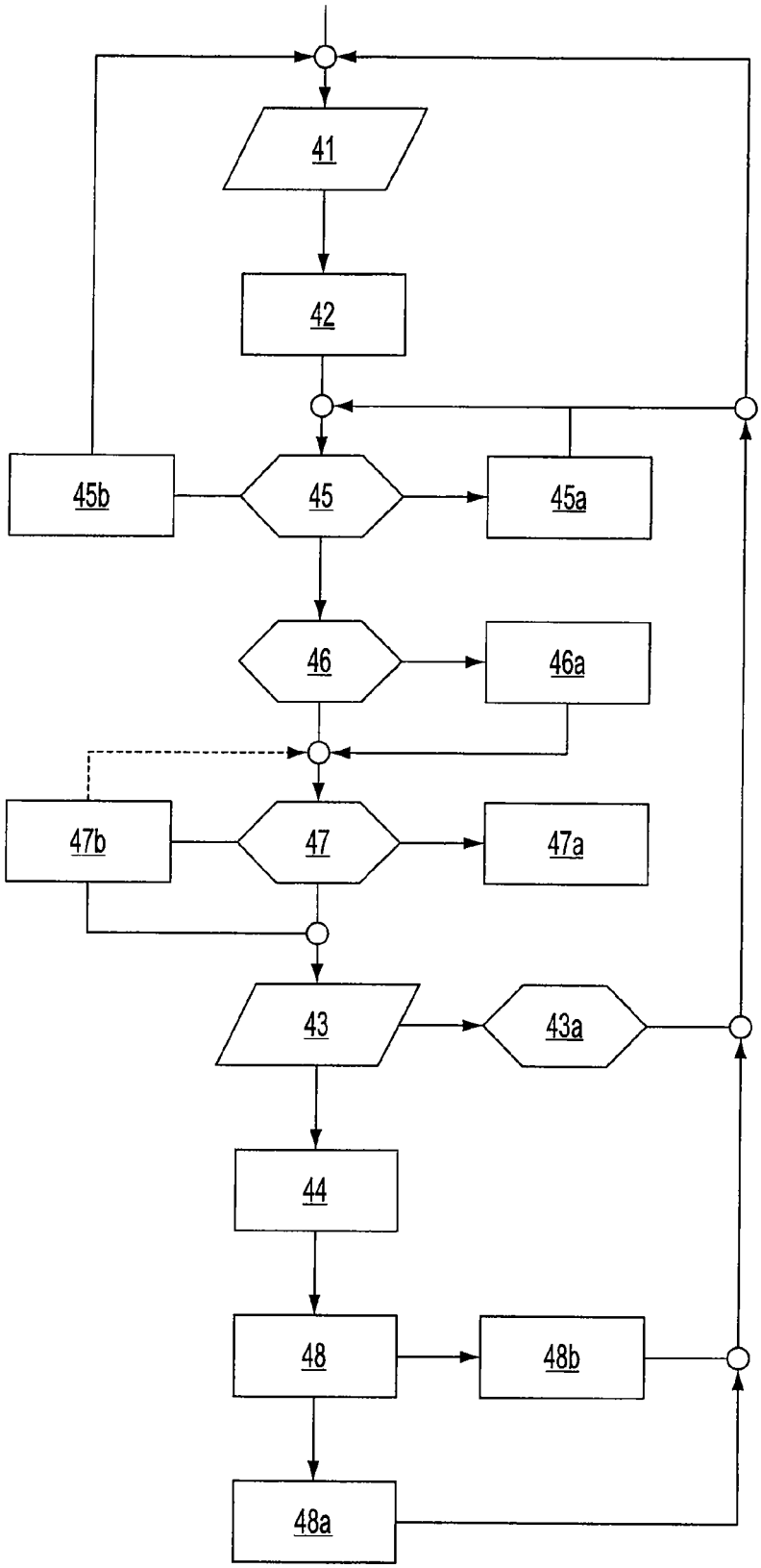

The drawings explain the invention on the basis of an embodiment, wherein:

FIG. 1 Depicts a vertical section through a pressing tool;

FIG. 2 Presents a schematic representation of a fluid system and the control unit of a pressing tool;

FIG. 3*a* and 3*b* Show the connection element of a pressing tool with jointing clamp inserted and the fastening bolt secured;

FIG. 4*a* and 4*b* Provide a schematic representation of a jointing clamp identification and FIG. 5 Shows a sequence schema for the pressing process.

FIG. 1 shows a pressing tool 13 in connection with which subsequently a housing element 1 with a drive motor 15 is arranged on a handle 14. The transmission shaft 16 of the drive motor 15 is connected with pump shaft 17 or a pump 4 represented by indication via a mounting and gearing arrangement 3. Preferably a typical commercial pump is used. The pressure side of the pump 4 is connectable with an intake opening 19 in a first front face 22 of the cylinder element 5 through a pressure conduit 18 and a control valve 11. A piston 20 is arranged advanceable by the pressure fluid or hydraulic fluid introduced away from the first front face 22 in the cylinder element 5. First guide and sealing rings 21 are arranged on the piston 20. A piston rod 6 is passed through an opening 24 in the second front face 23 of the cylinder element 5. Second guide and sealing rings 25 around the opening 24 guarantee a tight seal.

For resetting the piston 20, a return spring 20*a* (not drawn in, FIG. 2) is arranged in the annular space connecting to the cylinder jacket inside. Resetting is triggered by reversing the control valve 11. In a simple embodiment, the control valve 11 is activated as soon as the pressure in the pressure fluid acting on the piston 20 exceeds a threshold value. In the reset state, a fluid connection leads from the intake port 19 through the control valve 11 to a fluid reservoir 9 which once again is connected through a supply and return conduit 26 with the second cylinder partial space connecting with the second front face 23. Due to the use of the second cylinder partial space as a storage supplement, an extremely small size of the lifting cylinder is guaranteed with the pump 4 and the fluid guiding arrangement.

With the embodiment represented, a pressure sensor 10 is provided for measuring the pressure on the pressure side of the pump 4. A pressing force can be derived from the pressure value. With a pressing process, at least the maximum pressing pressure attained or the maximum pressing force attained should be recorded. With pressing tools in accordance with the state of the art, this maximum pressure value attained is compared with an expected value. If the pressure value measured lies above the expected value, it is assumed that the extrusion has taken place completely. The solutions now provide, in addition to or instead of pressure recording, a position recording in addition, for example with a position measuring device, especially with a distance sensor 12. In the example represented, the distance sensor 12 is a Hall sensor which measures the magnetic field of a magnet 12*a* attached on the piston 20. As already described, however, other measuring devices can be used as well. The arrangement of the components of a measuring device takes place such that the positional value of the piston is measurable as exactly as possible.

With the pressing tool 13 represented, the drive motor 15, the gearing 3, the pump 4, the fluid conduit system with the control valve 11, as well as the cylinder element 5 with the position measuring device and the piston 20 are constructed as a compact module. Such a module is usable as a lifting cylinder device for the most varied types of force-absorbing activations in one direction and can be reset in the other direction. Through the combination of two lifting devices acting opposite each other, a force-absorbing activation can also take place in both directions if necessary.

The pressing tool 13 in accordance with FIG. 1 includes a control unit 2 which can influence the drive motor 15 as well as make the piston position and/or the pressure value comparable with at least an expected value. In accordance with the respective values compared with each other, the indicator 27 signals a complete or an incomplete extrusion or a preselected piston position range value and/or the required data for the pressing tool and/or function problem required. The control unit 2 is preferably connected with the switch 7 through which a pressing process is triggered. On the free end of the piston rod 6, two pressure rollers 28 are attached. The pressure roller pair 28 is guided with a guide block 20 in a sliding bar 30. The sliding bar 30 is fastened in the cylinder element 5 and has a bore hole 31 for accommodating a fastening bolt 50 of a jointing clamp 51 (FIG. 3*a*—not represented) in the area of the free end. The open dies 51*a* and 51*b* (FIG. 3*a*) can each be pivoted about an axis of rotation 35*a* or 35*b* and have adjoining activation surfaces 34*a* and 34*b* on the pressure rollers 28. The activation surfaces 34*a* and 34*b* are constructed such that the pressure rollers 28, which are moved forward, move the open dies 51*a* and 51*b* together by means of swivelling motions about their axes of rotation 35*a* and 35*b* in the area of the workpiece to be extruded, especially press fittings 32*a*.

FIG. 2 illustrates the basic features of a lifting cylinder device on the basis of the fluid system and the control unit of a pressing tool. The interior space of the cylinder element 5 is subdivided by the piston 20 into a pressure area 5*a* and a reservoir area 5*b*.Resetting of the piston 20 takes place through the return spring 20*a*.The pressure area 5*a* is connectable with the pressure side of the pump 4 through a pressure conduit 18 and a control valve 11. The control valve 11 represented has two settings. In a first setting, the pressure area 5*a* is acted upon with pressure fluid. In the second setting, the pressure side of the pump is connected with the fluid reservoir 9 and the reservoir area 5*a*,or with the suction side of the pump. With hydraulic regulation, the control valve in the sense of an excess pressure valve is reversed by means of an excess pressure conduit 8*a* from the first into the second setting. Instead of hydraulic control on the excess pressure conduit 18*a*,an analogous pressure regulation could also take place through the pressure sensor 10 and the control unit 2. Here the pressure value measured by the pressure sensor 10 in the control unit 2 must be compared with a threshold pressure. If the threshold pressure is exceeded, the control unit 2 must change the valve setting through a valve control unit 11*a*.In the construction represented, the valve control unit 11*a* is also reversible by means of an emergency switch off.

In order to widen the invention's possible uses, especially in order to enable any desired positionings of the piston 20 or the piston rod 6, the distance sensor 12 is installed. In the example represented, the distance sensor 12 is a Hall sensor which measures the magnetic field of a magnet 12*a* attached to the piston 20. If need be, the piston position may be recorded by a sensor 112 which evaluates a signal reflected on the piston 20 or, the piston position is read by a reading head 212 of the cylinder element 5 on a scale 212*a* of the piston rod 6. The control unit 2 can process the positional values in accordance with the respective application and make appropriate control signals for the valve control 11*a* and/or the drive control 2*a*.

Instead of a control valve 11, a hydraulic control unit can be used which may include a pressure reservoir and/or a pressure reducing unit as well as at least one pilot valve. The control unit 2 makes any desired forward motion and positioning of the piston 20 possible through the distance sensor 12 and pressure measurement through the pressure sensor 10, as well as regulating the feed pressure and in particular the inflow amount to the pressure region 5*a* by means of hydraulic control. In order to be able to control an activation module with the properties described in various applications properly, the control unit 2 is connectable with a higher ranking control unit though a control connection 2*b*.

A lifting cylinder device in accordance with the invention is advantageously installable in the conduit system for loose material or fluids for activating discharge and dosing elements or valves. If a controllable closing is needed, then preferably the pressure-activated stroke is used for closing. Moreover, proceeding from a large flow through diameter for reaching a required overall amount, a closing part of the lifting cylinder can be so readjusted that the flow through diameter becomes smaller and is closed at the right moment. This is advantageous for a rapid and exact dosing. The opening of a valve is guaranteed by allowing the pressure fluid to flow out of the pressure area 5*a* and resetting the piston 20 by the return spring. If, when interrupting the flow for safety reasons, closing the valves is required, then it is appropriate to use the return spring 20*a* for closing. The hydraulic control unit is then constructed such that in the flowless state, the fluid can exit from the pressure area 5*a* and the return spring 20*a* can reset the piston 20. The return spring 20*a* is laid out such that it can close the valve. Valves activated in this way are especially advantageously usable in chemical facilities for safety reasons.

FIG. 3*a* shows a connection piece 33 of the pressing tool 13, FIG. 3*b* a segment thereof with the piston rod 6, the pressure rollers 28 and the guide block 29 which is led in a sliding bar 30. The sliding bar 30 is fastened on the cylinder element 5 and has the bore hole 31 for accommodating a fastening bolt 50 of a jointing clamp 51 in the area of the free end. The open dies 51*a* and 51*b* can each be swivelled about a rotating axis 35*a* and 35*b* and have activation surfaces 34*a* and 34*b* adjacent to the pressure rollers. The activation surfaces 34*a* and 34*b* are constructed such that the pressure rollers 28 moved forward move the open dies 51*a* and 51*b* together by means of swivelling motions about their axes of rotation 35*a* and 35*b* in the area of the press fittings 32*a* to be extruded, whereby the press fitting 32*a* together with the pipe ends to be joined is slid into an opening 32 of the jointing clamp 51.

In order to enable a jointing clamp presence check 45 (FIG. 5), a presence sensor 52, especially one which measures without contact, is arranged in the sliding bar 30 so that it makes a field property determinable which can be clearly differentiated in the event that the jointing clamp 51 is present or absent. When no jointing clamp is present, an acoustic and/or optical indicator signal is triggered and the jointing clamp presence surveillance 45 is subsequently conducted again. If a jointing clamp still has not been inserted or has only been improperly inserted after a delay period, the pressing tool is returned to the initial status by a delay time facility. An inductive sensor is preferably used as an inductive sensor which makes the presence of any desired jointing clamp 51 of metal detectable.

If the jointing clamp is present, it must in addition be assured that the fastening bolt 50, which connects the jointing clamp 51 with the pressing tool 13, has been properly installed. The fastening bolt 50 includes a handle 50*a* running across the bolt axis which is oriented in a first direction when the fastening bolt 50 is inserted. In this orientation, the bolt longitudinal groove 50*b* accommodates a guide pin 53 which lies in an annular groove 50*d* when the fastening bolt 50 is fully slid in so that the fastening bolt 50 can be rotated 150° in a latching position. A bolt latching check 47 (FIG. 5) provides that the fastening bolt 50 in monitorable in the latching position. For this, preferably the grip 50*a* is provided with a latching magnet 50*c* which in the latched state or in the latching state bounds upon a latching sensor 54 in the pressing tool 13. When the latching sensor 54 detects a magnet, then the fastening bolt 50 is in the latching position. It is obvious that, instead of the Hall sensor, an inductive sensor can also be used, for example.

A sensing device which measures without contact is provided for measuring the jointing clamp coordination 46 (FIG. 5). A piston position range value required for a complete extrusion or preferably a tolerance range allocated to the piston position range value can be determined automatically on the basis of the coordination measured. The measurement should take place free of or without contact because otherwise disturbances can occur owing to contamination, oxidation or short circuit. A preferred solution provides that the jointing clamp coordination 46 (FIG. 5) provides for the possibility of installing a coordination magnet 55 approximately on five positions of the jointing clamp 51. Blind bore holes are applied for this, for example. The positions for coordination magnets 55 lie opposite appropriately arranged coordination Hall sensors 56 when a jointing clamp 51 has been installed so that the coordination hall sensors 56 make the presence of coordination magnets 55 detectable. Through a larger number of Hall sensors and positions for magnets, a larger number of coordinations are made possible.

In order to make possible, for example, 32 different jointing clamp coordinations, the possibility for installing a permanent magnet or coordination magnets 55 is provided approximately in accordance with FIG. 4*a* and 4*b* at five positions of the jointing clamp 51. The positions for the coordination magnets 55 lie opposite appropriately arranged coordination Hall sensors 56 when the jointing clamp 51 is inserted so that the coordination Hall sensors 56 make the presence of coordination magnets 55 detectable. With a greater number of Hall sensors and positions for magnets, a larger number of coordinations are made possible.

FIG. 4*a* schematically depicts the cooperation of these two elements on the basis of a section through the connection area of a jointing clamp 51 and though a coordination Hall sensor 56. FIG. 4*b* illustrates the distribution of the sensors on the basis of an elevation.

FIG. 5 visualizes a pressing process for pressing home casing-shaped press fittings 32*a* with a pressing tool in connection with which the piston 20 (FIG. 1) is slid forward by the pressure fluid of the fluid pump 4 (FIG. 1) in a cylinder element 5 (FIG. 1), and is reset after opening a return valve by a return spring 20*a* (FIG. 2) after a threshold pressure is reached in the pressure fluid, whereby the piston 20 activates the clamping motion of at least one open die 51*a* or 51*b* (FIG. 3*a*) through a transmission device. The pressing tool is turned on with a turning on operation 41 in connection with an on/off switch 7 (FIG. 1). After this, reliability, start and service tests are conducted in an initializing operation 42. Before a pressing process 44 together with the measurement of operating parameters can be triggered in a triggering operation 43, it must be determined in a repeatable second step whether the pressing tool 13 is ready to initiate a pressing process 44. In the framework of the second step, a jointing clamp presence check 45 is conducted until a jointing clamp 51 (FIG. 3*a*) is installed. As long as no jointing clamp 51 is present, an acoustic and/or optical indicator signal 45*a* is triggered, retained, and subsequently the jointing clamp presence check 45 is conducted again. If following a delay period no jointing clamp 51 is yet inserted or has been improperly inserted, the pressing tool 13 (FIG. 1) is returned to the initial state by a delay time facility. The pressing tool cannot be started. In order once again to trigger a pressing process 44, a jointing clamp 51 must be introduced into the pressing tool 13 and fastened by means of the fastening bolt 50 (FIG. 3*b*) on the pressing tool 13. In the event that a jointing clamp 51 was already present, care must be taken that the jointing clamp 51 is properly installed in the connection piece 33 (FIG. 3*a*).

If a jointing clamp 51 is installed, a jointing clamp coordination 46 is conducted following a delay period in order to allocate to the inserted jointing clamp 51 a piston position range value. Here if a coordination is lacking, a standard value is assigned. As a further control operation before approval for the triggerability of a pressing process 44, preferably a bolt latching check 47 is conducted in order at least to trigger a warning signal 47*a* in the event that a fastening bolt 50 is not secured. If need be, the bolt latching check 47 is repeated until the fastening bolt 50 is locked or is secured. After these control operations 45–47 have been successfully conducted, the pressing tool 13 is ready for starting a pressing process 44. When the pressing process 44 is not triggered within a specified time, then a resting time check 43*a* detects whether the pressing tool 13 was already turned on during a specified maximal resting period without pressing process 44. In the event that the maximal resting time has not been reached yet, the pressing tool runs through the second step or surveillance operations 45–47 again. In the event that the maximum resting time has been reached, the pressing tool is shut off.

The pressing tool is associated with further monitoring steps. For this, reaching, and in particular the time until reaching, a pressure value in the lifting cylinder device is monitored. When this pressure value is reached, the current piston position is measured and a resetting process is conducted to reset the piston. A time control establishes whether the time required to reach the pressure value lies above a specified threshold time. If this is the case, then an acoustic and/or optical warning signal is issued and preferably an appropriate error code is stored. If the piston end position does not correspond to the allocated piston position range value or does not lie in the tolerance range around the piston position range value, an acoustic and/or optical warning signal is triggered and preferably an appropriate error code is stored. The comparison of the measured value with comparison values which characterize a complete extrusion takes place in a comparison step 48. In accordance with the comparison result, a complete extrusion is indicated in a first indicator step 48*a*,or a warning signal and an error message are generated or stored in a second indicator step 48*b*. Before a further pressing process 44 can be made triggerable, control operations 45–47 must be conducted again.

The invention claimed is:

1. A method of activating a pressing tool, the pressing tool having a transmission device for actuating a pressing jaw, the pressing jaw interchangeably connecting on the pressing tool with a fastening pin, the method comprising the steps of:

(a) electronically detecting for the presence of the pressing jaw on the pressing tool;

(b) repeating step (a) if the presence of the pressing jaw is not detected in step (a), whereby steps (a) and (b) are repeated up to a first time delay at which point the pressing tool is shut off;

(c) electronically detecting for the presence of the fastening pin on the pressing tool if the presence of the pressing jaw is detected in step (a);

(d) repeating step (c) if the presence of the fastening pin is not detected in step (c); and (e) electronically enabling the transmission device to actuate the pressing jaw if the presence of the pressing jaw is detected in step (a) and the presence of the fastening pin is detected in step (c).

2. The method of claim 1, wherein step (a) comprises electronically detecting for a magnetic property, and inductive property, a pressure, or a contact of a portion of the pressing jaw.

3. The method of claim 1, wherein step (a) further comprises indicating a first warning signal if the presence of the pressing jaw is not detected.

4. The method of claim 1, wherein step (c) comprises electronically detecting for a magnetic property, an inductive property, a pressure, or a contact of a portion of the fastening pin.

5. The method of claim 1, wherein step (c) further comprises indicating a second warning signal if the presence of the fastening pin is not detected.

6. The method of claim 1, wherein step (d) further comprises repeating steps (c) and (d) up to a second time delay.

7. The method of claim 6, wherein step (d) further comprises returning to step (a) after the second time delay if a predetermined maximum on-time without enabling the transmission device in step (e) has not been reached.

8. The method of claim 7, wherein step (d) further comprises switching off the pressing tool after the second time delay if the predetermined maximum on-time without enabling the transmission device in step (e) has been reached.

9. A method of activating a pressing tool, the pressing tool having a transmission device for actuating a pressing jaw, the pressing jaw interchangeably connecting on the pressing tool with a fastening pin, the method comprising the steps of:

(a) electronically detecting for the presence of the pressing jaw on the pressing tool;

(b) repeating step (a) if the presence of the pressing jaw is not detected in step (a), whereby steps (a) and (b) are repeated up to a first time delay at which point the pressing tool is shut off, (c) electronically detecting for the presence of the fastening pin in the hole of the pressing tool if the presence of the pressing jaw is detected in step (a);

(d) repeating step (c) if the presence of the fastening pin is not detected in step (c), whereby steps (c) and (d) are repeated up to a second time delay at which point steps (f) or (g) are performed;

(e) electronically enabling the transmission device to actuate the pressing jaw if the presence of the pressing jaw is detected in step (a) and the presence of the fastening pin is detected in step (c);

(f) returning to step (a) if a predetermined maximum on-time without enabling the transmission device in step (e) has not been reached; and (g) electronically switching off the pressing tool if the predetermined maximum on-time without enabling the transmission device in step (e) has been reached.

* * * * *